US008740667B2

(12) United States Patent
Kodera et al.

(10) Patent No.: US 8,740,667 B2
(45) Date of Patent: Jun. 3, 2014

(54) POLISHING METHOD AND POLISHING APPARATUS

(75) Inventors: Masako Kodera, Yokohama (JP); Yukiteru Matsui, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 152 days.

(21) Appl. No.: 13/415,143

(22) Filed: Mar. 8, 2012

(65) Prior Publication Data

US 2013/0115855 A1 May 9, 2013

(30) Foreign Application Priority Data

Nov. 8, 2011 (JP) ..... 2011-244581

(51) Int. Cl.
*B24B 37/015* (2012.01)

(52) U.S. Cl.
USPC ..... 451/7; 451/41; 451/53; 451/287; 451/449

(58) Field of Classification Search
USPC ..... 451/7, 36, 41, 53, 59, 63, 285, 287, 451/288, 449
See application file for complete search history.

(56) References Cited

U.S. PATENT DOCUMENTS

| | | | | |
|---|---|---|---|---|
| 5,733,177 | A * | 3/1998 | Tsuchiya et al. | 451/41 |
| 6,905,397 | B2 * | 6/2005 | Sharan | 451/53 |
| 7,201,634 | B1 * | 4/2007 | Naujok et al. | 451/7 |
| 7,513,819 | B2 * | 4/2009 | Kiuchi et al. | 451/7 |
| 7,837,534 | B2 * | 11/2010 | Aiyoshizawa et al. | 451/7 |
| 8,172,641 | B2 * | 5/2012 | Ho et al. | 451/7 |
| 2004/0087248 | A1 * | 5/2004 | Hirokawa | 451/7 |
| 2011/0081832 | A1 * | 4/2011 | Nakamura et al. | 451/28 |
| 2012/0034846 | A1 * | 2/2012 | Minamihaba et al. | 451/7 |

FOREIGN PATENT DOCUMENTS

JP 2000-254855 9/2000

OTHER PUBLICATIONS

Akifumi Gawase et al., "CMP Apparatus, Polishing Pad and CMP Method", U.S. Appl. No. 13/233,960, filed Sep. 15, 2011.

* cited by examiner

*Primary Examiner* — Eileen P. Morgan
(74) *Attorney, Agent, or Firm* — Finnegan, Henderson, Farabow, Garrett & Dunner, L.L.P.

(57) ABSTRACT

According to one embodiment, a polishing method comprises pressing a substrate being rotated against a polishing pad being rotated and supplying slurry on the polishing pad, measuring a surface temperature of the polishing pad, and when the surface temperature is not less than a predetermined temperature, jetting jet stream containing supercooled droplets from a nozzle having a narrow portion toward the polishing pad.

20 Claims, 3 Drawing Sheets

POLISHING METHOD AND POLISHING APPARATUS

CROSS REFERENCE TO RELATED APPLICATION

This application is based upon and claims benefit of priority from the Japanese Patent Application No. 2011-244581, filed on Nov. 8, 2011, the entire contents of which are incorporated herein by reference.

FIELD

Embodiments described herein relate generally to a polishing method and a polishing apparatus.

BACKGROUND

When a thin film and a substrate surface are planarized in a manufacturing process of an LSI device and so on, a chemical mechanical planarization method (CMP method) has been put to practical use. With miniaturization of an LSI device and reduction in the cost, there is required a CMP technique of processing a device surface into flatter, a lower level of defects, and more inexpensively.

In the CMP method, since slurry (polishing agent) containing polishing abrasive grains is used, there is a problem that scratches (polishing flaw) caused by abrasive grain residues cannot be prevented completely. Although the number of scratches and the size can be suppressed with improvement of the CMP method, with the miniaturization of the LSI device, in the future a construction of a several nm order is required to be processed without damage. For example, in a STI (Shallow Trench Isolation) process in LSI manufacture, a $SiO_2$ film formed on the entire surface while covering a minute groove pattern is polished and removed without damage by the CMP method, and the $SiO_2$ film is required to be embedded only in the groove. Since a transistor is formed on the polished surface, it is especially required to suppress scratches.

For the above problem, there has been known CMP temperature control as the CMP technique with high flatness, a low level of defects, and high productivity. In conventional CMP temperature control, air is jetted toward a polishing pad surface in CMP, and the pad surface and slurry on the surface are cooled. However, this method is cooling utilizing heat of vaporization of the slurry according to air blow, and the cooling capacity is insufficient.

Meanwhile, in order to suppress scratches, CMP is required to be performed after removing residues and foreign matters on the polishing pad. As a conventional removal method, a diamond dresser is pressed against the polishing pad surface between polishing operations, and the pad surface is scraped by approximately 1 μm and cleaned while flowing a cleaning liquid such as purified water. This cleaning is called dressing. The diamond dresser is a disk with a large number of minute industrial diamonds arranged on the surface. When diamond microparticles are dropped, this is a major cause of a large scratch. Although it is preferable to perform dressing in the CMP process in terms of productivity of LSI, the diamond microparticles may be dropped; therefore, dressing is performed between the polishing operations, and this interferes with the improvement of the productivity.

The polishing pad is generally formed of foamed polyurethane, and the pore diameter of a foam is several ten μm. Since a foam portion is exposed on the polishing pad surface, a myriad of pores with a depth of several ten μm appear on the pad surface. In order to enhance slurry retention capacity, a large number of vertical holes with a depth of several hundred μm are often formed in the pad surface. Thus, a large number of the pores with a depth of from several ten μm to several hundred μm are formed in the pad surface. Although the polishing pad surface can be cleaned by the diamond dresser, polish residues and foreign matters accumulated in a deep portion of each pore cannot be removed, and thus the polish residues discharged from the pores may cause scratches.

DETAILED DESCRIPTION

According to one embodiment, a polishing method comprises pressing a substrate being rotated against a polishing pad being rotated and supplying slurry on the polishing pad, measuring a surface temperature of the polishing pad, and when the surface temperature is not less than a predetermined temperature, jetting jet stream containing supercooled droplets from a nozzle having a narrow portion toward the polishing pad.

Figure 1:
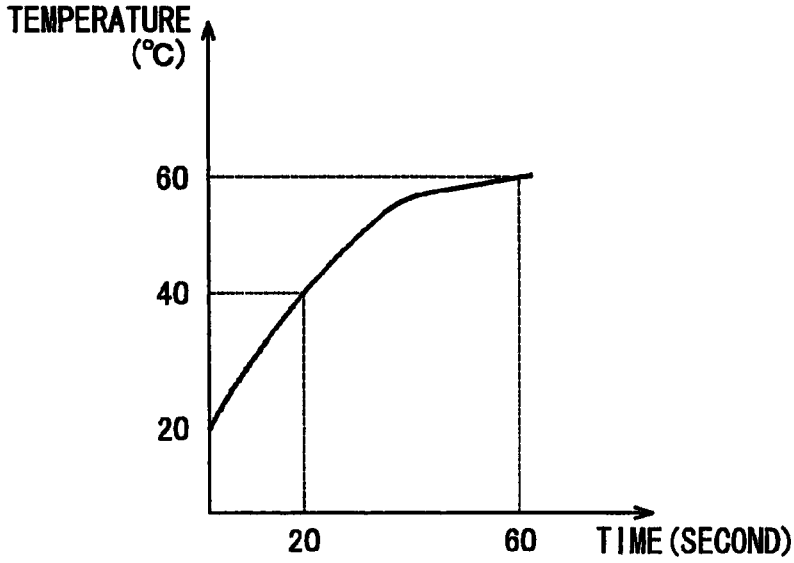
FIG. 1 is a graph showing an example of time variation of surface temperature of a polishing pad under CMP processing.

Before the description of an embodiment of the present invention, a background that the present inventors made the present invention will be described. FIG. 1 shows an example of time variation of surface temperature of a polishing pad under CMP processing. As shown in FIG. 1, when a polishing table and a wafer start to be rotated and start polishing process, the surface temperature is gradually increased by frictional heat with increase of the rotation speed. For example, the surface temperature of about 20° C. at the start of polishing increases to about 40° C. after a lapse of 20 seconds. Thereafter, after a lapse of 60 seconds, the surface temperature increases to approximately 60° C. When the slurry used in the polishing is Cu CMP slurry, for example, a complex-forming agent and an oxidizing agent are contained. The complex-forming agent and the oxidizing agent are decomposed in a high-temperature region of 50° C. to 60° C., and the slurry is deteriorated. When the slurry is deteriorated, the flatness of the wafer surface is lowered, and therefore, the surface is immediately cooled before the surface temperature reaches a high temperature range, and the surface temperature is required to be maintained at approximately 40° C. suitable for the polishing performance of the slurry.

In the following embodiment, the above problem can be solved. Hereinafter, the embodiment of the present invention will be described based on the drawings.

Figure 2:
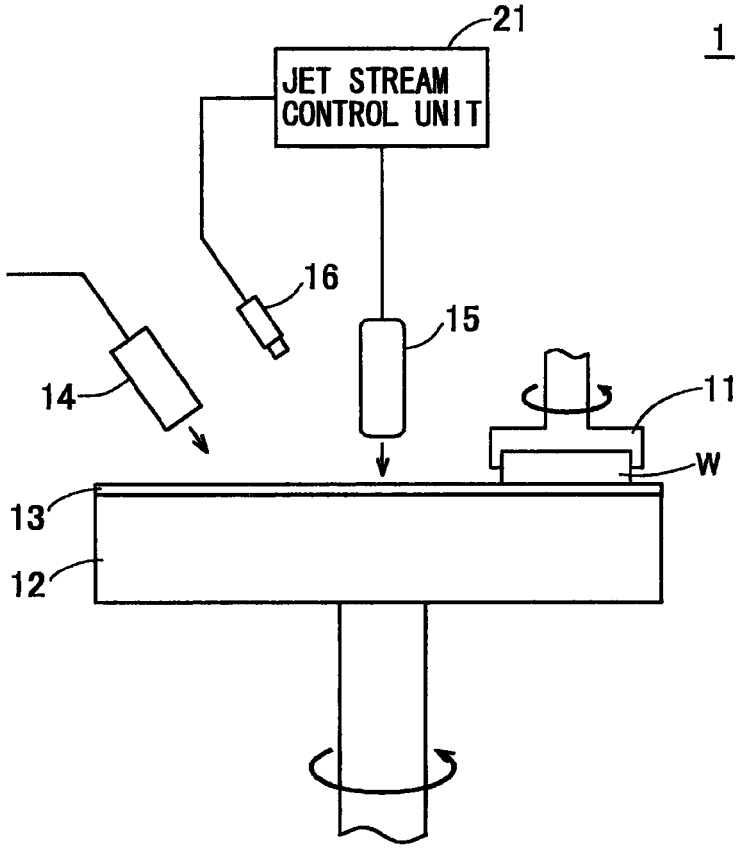
FIG. 2 is a schematic configuration diagram of a polishing apparatus according to an embodiment of the present invention.

FIG. 2 shows a schematic configuration of a polishing apparatus according to the embodiment of the present invention. A polishing apparatus 1 comprises a top ring 11 as a polished body holding unit, a polishing table 12, a supply nozzle 14 through which slurry (polishing agent) is supplied, and a Laval nozzle 15.

The top ring 11 is provided with an air cylinder mechanism (not shown) adding a load to the top ring 11. In the top ring 11, a wafer (substrate) W as a polished body is held by a vacuum chuck through an elastic member (not shown) such as rubber. The top ring 11 is connected to a drive mechanism (not shown) and can be moved and rotated in a vertical direction by the drive mechanism.

The polishing table 12 is arranged below the top ring 11, and a polishing pad 13 is applied onto the upper surface of the polishing table 12. The polishing table 12 can be rotated by a drive mechanism (not shown).

The supply nozzle (supply unit) 14 is provided above the polishing table 12 and supplies the slurry onto the polishing pad 13.

Figure 3:
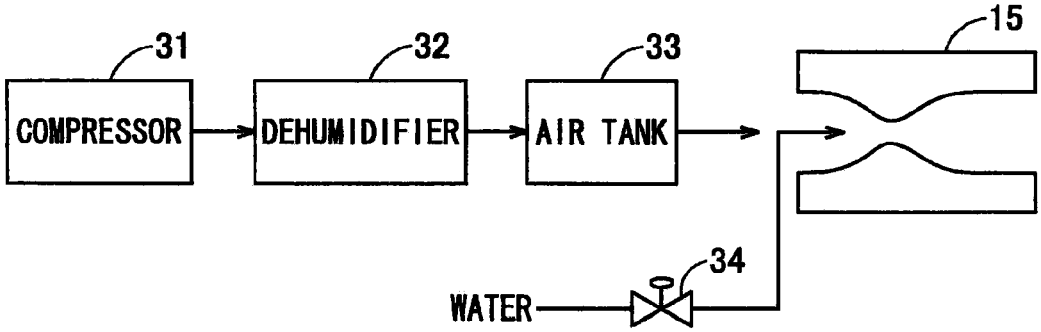
FIG. 3 is a schematic configuration diagram of a Laval nozzle.

The Laval nozzle 15 jets jet stream containing supercooled droplets onto the polishing pad 13 to cool the surface of the polishing pad 13. As shown in FIG. 3, the Laval nozzle 15 has a structure in which a throat portion (narrow portion) is provided at an intermediate portion of a cylindrical nozzle. By virtue of the use of the Laval nozzle 15, a liquid is atomized, and, at the same time, solid-liquid bilayer sprayed particle group containing ice particles can be formed by quenching effect according to adiabatic expansion.

For example, as shown in FIG. 3, air compressed by a compressor 31 is dehumidified by a dehumidifier 32 and accumulated in an air tank 33. The air in the air tank 33 is adjusted to a predetermined pressure by a pressure reducing valve, and a valve is opened, whereby compressed air is introduced into the Laval nozzle 15. In the compressed air, it is preferable that the pressure is not less than 300 kPa and the flow rate is not less than 200 NL/min. A small amount of room-temperature water is supplied near the throat portion of the Laval nozzle 15. For example, the flow rate of water is adjusted to not more than 100 ml/min by the valve 34. The water is preferably purified water.

The compressed air and the flow rate of water supplied to the Laval nozzle 15 can be controlled by a jet stream control unit 21 shown in FIG. 2.

The water supplied to the Laval nozzle 15 becomes a large number of minute droplets by a high-pressure air jet stream. Since the nozzle diameter of the Laval nozzle 15 is expanded downstream from the throat portion, minute water droplets are cooled to a supercooling temperature by adiabatic expansion. When the supercooled droplets reach on the polishing pad 13, they are frozen, and the surface of the polishing pad 13 and the slurry can be efficiently cooled by the fusion heat and vaporization heat according to high-pressure air.

As shown in FIG. 2, the polishing apparatus 1 comprises a temperature sensor 16 measuring the surface temperature of the polishing pad 13. The temperature sensor 16 is an infrared radiation thermometer, for example. The jet stream control unit 21 obtains measurement results of the temperature sensor 16 and controls jetting of the supercooled droplets from the Laval nozzle 15 based on the surface temperature of the polishing pad 13.

Figure 4:
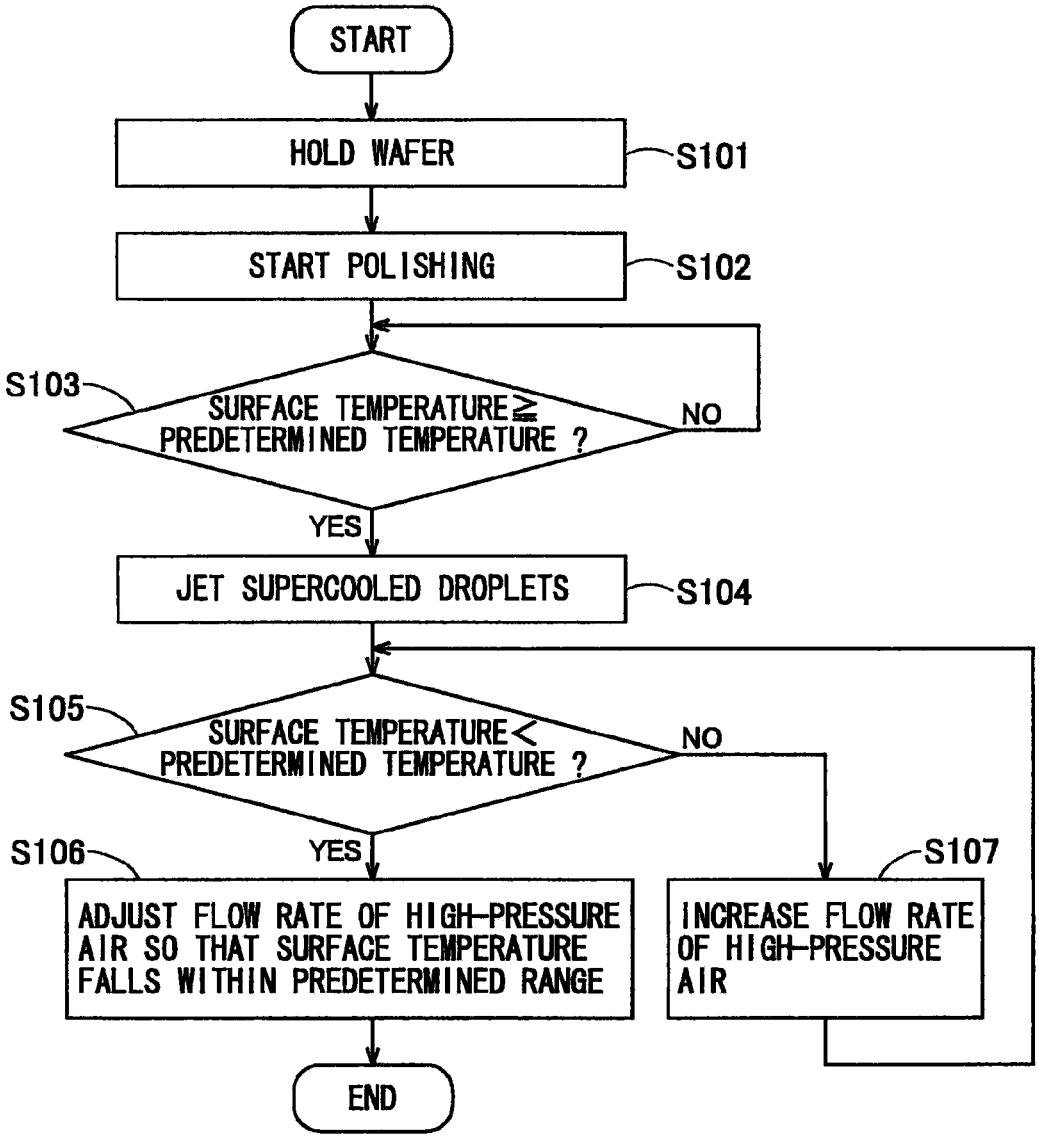
FIG. 4 is a flow chart for explaining a polishing method according to the present embodiment.

Next, a method of polishing a polished body using the polishing apparatus 1 will be described using a flow chart shown in FIG. 4.

(Step S101)

The wafer W as the polished body is held by the top ring 11.

(Step S102)

The top ring 11 and the polishing table 12 are rotated by a drive mechanism. The top ring 11 is lowered downward, and the wafer W is pressed against the polishing pad 13 with a certain load. The slurry is supplied onto the polishing pad 13 from the supply nozzle 14 in this state, whereby polishing is performed.

(Step S103)

The surface temperature of the polishing pad 13 is measured using the temperature sensor 16. The surface temperature is gradually increased by frictional heat and an intentionally added heat source. When the surface temperature is not less than a predetermined temperature, the process proceeds to step S104.

The predetermined temperature is, for example, a temperature at which the slurry is deteriorated (a temperature at which a complex-forming agent, an oxidizing agent, and so on contained in the slurry are thermally decomposed) and is changed according to components of the slurry.

(Step S104)

The jet stream control unit 21 jets the supercooled droplets from the Laval nozzle 15 to the polishing pad 13.

(Step S105)

When the surface temperature of the polishing pad 13 is lowered to less than a predetermined temperature, the process proceeds to step S106. When the surface temperature is not lowered, the process proceeds to step S107.

(Step S106)

The jet stream control unit 21 adjusts the flow rate of high-pressure air supplied to the Laval nozzle 15 so as to prevent the surface temperature of the polishing pad 13 from being not less than a predetermined temperature. At this time, the jet stream control unit 21 adjusts the flow rate of the high-pressure air supplied to the Laval nozzle 15 so as to prevent the surface temperature from being lowered too much. This is because when the temperature is too low, the polishing performance of the slurry is lowered. Accordingly, the jet stream control unit 21 adjusts the flow rate of the high-pressure air supplied to the Laval nozzle 15 so that the surface temperature of the polishing pad 13 falls within a predetermined range.

(Step S107)

The jet stream control unit 21 increases the flow rate of the high-pressure air supplied to the Laval nozzle 15 so that the surface temperature of the polishing pad 13 is less than a predetermined temperature. The flow rate of the high-pressure air is increased, whereby the temperature of the supercooled droplets jetted from the Laval nozzle 15 is lowered.

As described above, according to the present embodiment, when the surface temperature of the polishing pad 13 is not less than a predetermined temperature, the supercooled droplets are jetted to the polishing pad 13, whereby the surface of the polishing pad 13 and the slurry can be quickly cooled by the fusion heat and vaporization heat according to the high-pressure air. In the cooling using the supercooled droplets, the cooling rate is about six times (time required for cooling is about ⅙) in comparison with a conventional air blow method (cooling only according to slurry vaporization heat).

Accordingly, the polishing pad and the slurry can be efficiently cooled by the polishing method and the polishing apparatus according to the present embodiment.

In the above embodiment, when the surface temperature of the polishing pad 13 is not less than a predetermined temperature, the supercooled droplets are jetted. However, a relationship between the rotation speed of the top ring 11 and the polishing table 12 and a variation with time of the surface temperature of the polishing pad 13 is previously investigated, and the supercooled droplets may be jetted according to whether or not the time when the surface temperature increases to a predetermined temperature has elapsed.

Figure 5:
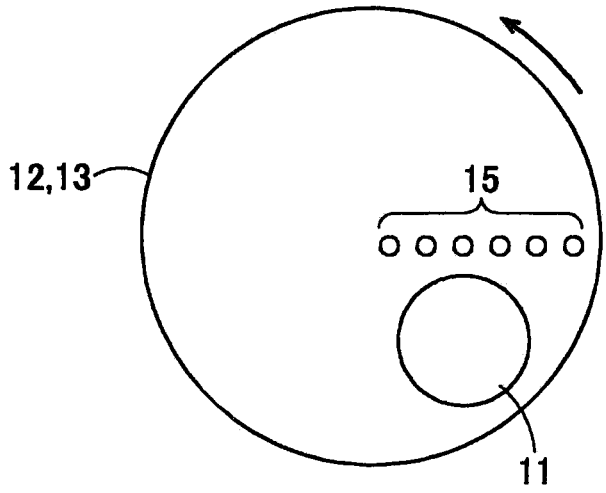
FIG. 5 is a view showing an example of arrangement of the Laval nozzles.

FIG. 5 shows an arrangement example of the Laval nozzles 15 of the polishing apparatus 1. A plurality of the Laval nozzles 15 are linearly arranged from the center of the polishing table 12 toward the outer peripheral direction. The Laval nozzles 15 are preferably provided adjacent to the downstream side in the rotational direction of the polishing table 12 of the top ring 11. This region is a region immediately after polishing because the region is a region where each temperature of the surface of the polishing pad 13 and the slurry is highest.

Figure 6:
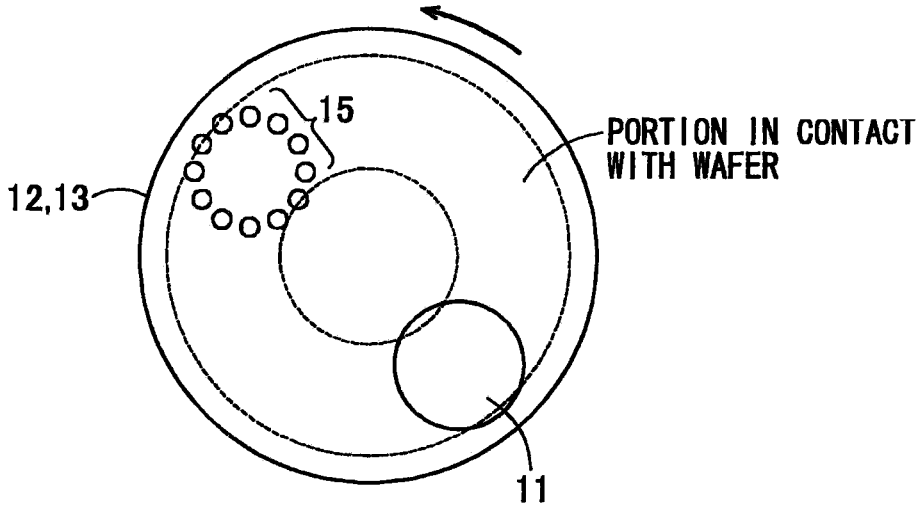
FIG. 6 is a view showing an example of arrangement of the Laval nozzles.

As shown in FIG. 6, a plurality of the Laval nozzles 15 may be arranged in a circular pattern. At this time, it is preferable that the Laval nozzles 15 are arranged so that the supercooled droplets can be supplied to a portion of the polishing pad 13 in contact with the wafer W held by the top ring 11.

The polishing apparatus 1 shown in FIG. 2 can be used in dressing of the polishing pad 13. The supercooled droplets jetted from the Laval nozzle 15 are frozen on the surface of the polishing pad 13. The supercooled droplets enter into pores with a depth of several ten μm existing in the pad surface and are frozen. At this time, the supercooled droplets catch therein residues and foreign matters existing inside the pores and are frozen. After that, at the time of discharging the frozen droplets by pressure of air, the residues and the foreign matters are discharged outside the pores along with the droplets.

In the dressing using the polishing apparatus 1, since the diamond dresser is not used, there is no possibility that a large scratch associated with drop of the diamond microparticles is created. Accordingly, dressing is not required to be performed between the polishing of one polished body and the polishing of the next polished body, and since dressing can be performed during the polishing operation, the productivity can be enhanced.

The polishing apparatus according to the present embodiment is used thus, so that dressing of the polishing pad surface can be efficiently performed.

Water (purified water) supplied to the Laval nozzle 15 is replaced with organic acid dissolving residues or a surfactant water solution, whereby the performance of dressing can be further enhanced. The organic acid may become a soluble reactant by, for example, forming a complex with residues. The soluble reactant is used because it can be removed in subsequent water rinsing process.

In the dressing using water jetting, the amount of purified water to be used is extremely large such as not less than several liters per minute, and, at the same time, if the large amount of water is flowed during the CMP process, the slurry is substantially diluted to lower the polishing performance. Thus, the dressing using water jetting has to be performed between the polishing operations, and the dressing cannot be efficiently performed unlike the case of using the polishing apparatus 1.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A polishing method comprising:

pressing a substrate being rotated against a polishing pad being rotated, and supplying slurry on the polishing pad;

measuring a surface temperature of the polishing pad; and jetting jet stream containing supercooled droplets which have a temperature lower than a freezing point of the droplets, from a nozzle whose flow path includes a first portion having a first cross-sectional area, a second portion having a second cross-sectional area, and a narrow portion located between the first and second portions and having a third cross-sectional area smaller than the first and second cross-sectional areas toward the polishing pad, when the surface temperature of the polishing pad is not less than a predetermined temperature.

2. The polishing method according to claim 1, further comprising adjusting flow rate of air supplied to the nozzle so that the surface temperature falls within a predetermined range.

3. The polishing method according to claim 1, wherein the predetermined temperature is determined by a thermal decomposition temperature of a complex-forming agent and an oxidizing agent contained in the slurry.

4. The polishing method according to claim 1, wherein the supercooled droplets contain organic acid or surfactant reacted with residues on the polishing pad.

5. The polishing method according to claim 1, wherein compressed air with a pressure of not less than 300 kPa and a flow rate of not less than 200 NL/min and water with a flow rate of not more than 100 ml/min are supplied to the nozzle to jet the jet stream.

6. The polishing method according to claim 1, wherein the nozzle is a Laval nozzle.

7. The polishing method according to claim 1, wherein in the nozzle, the nozzle diameter is expanded downstream from the throat portion.

8. The polishing method according to claim 1, wherein the time for the surface temperature to reach the predetermined temperature is calculated based on a relationship between a rotation speed of the polishing pad and a variation with time of the surface temperature, and after a lapse of the calculated time from the start of the rotation of the polishing pad, the jet stream is jetted from the nozzle.

9. The polishing method according to claim 1, wherein the jet stream is jetted on the downstream side in the rotational direction of the polishing pad.

10. A polishing apparatus comprising:

a holding unit configured to hold a substrate rotatably and vertically movably;

a polishing table rotatably provided below the holding unit and having a polishing pad applied onto an upper surface of the polishing table;

a supply unit configured to supply slurry on the polishing pad;

a temperature sensor configured to measure a surface temperature of the polishing pad; and a nozzle whose flow path includes a first portion having a first cross-sectional area, a second portion having a second cross-sectional area, and a narrow portion located between the first and second portions and having a third cross-sectional area smaller than the first and second cross-sectional areas, and configured to jet jet stream containing supercooled droplets which have a temperature lower than a freezing point of the droplets toward the polishing pad when the surface temperature measured by the temperature sensor is not less than a predetermined temperature.

11. The polishing apparatus according to claim 10, wherein the predetermined temperature is determined by a thermal decomposition temperature of a complex-forming agent and an oxidizing agent contained in the slurry.

12. The polishing apparatus according to claim 10, wherein the supercooled droplets contain an organic acid or a surfactant reacted with residues on the polishing pad.

13. The polishing apparatus according to claim 10, wherein the nozzle is provided adjacent to the downstream side in the rotational direction of the polishing table of the holding unit.

14. The polishing apparatus according to claim 10, wherein the nozzle jets the jet stream into a region of the polishing pad in contact with the substrate.

15. The polishing apparatus according to claim 10, wherein the nozzle is a Laval nozzle.

16. The polishing apparatus according to claim 10, wherein in the nozzle, the nozzle diameter is expanded downstream from the throat portion.

17. The polishing apparatus according to claim 10, further comprising a control unit adjusting flow rate of air supplied to the nozzle so that the surface temperature falls within a predetermined range.

18. The polishing apparatus according to claim 10, wherein the nozzle is provided adjacent to the holding unit.

19. The polishing apparatus according to claim 10, wherein a plurality of the nozzles are linearly arranged from the center of the polishing table toward the outer peripheral direction.

20. The polishing apparatus according to claim 10, wherein a plurality of the nozzles are arranged in a circular pattern.

* * * * *